US005091066A

United States Patent [19]

Foá et al.

[11] Patent Number: 5,091,066

[45] Date of Patent: Feb. 25, 1992

[54] ELECTROCHEMICAL SYNTHESIS OF 2-METHYL-5-PYRAZINOIC ACID

[75] Inventors: Marco Foá, Novara; Fabrizio Forlini, Pavia; Norberto Gatti, Novara; Giampiero Borsotti, Novara, all of Italy

[73] Assignee: Presidenza del Consiglio dei Ministri, Rome, Italy

[21] Appl. No.: 707,310

[22] Filed: May 29, 1991

Related U.S. Application Data

[63] Continuation of Ser. No. 271,675, Nov. 16, 1988.

[30] Foreign Application Priority Data

Nov. 19, 1987 [IT] Italy ..... 22693 A/87

[51] Int. Cl.[5] ..... C25B 3/02

[52] U.S. Cl. ..... 204/78

[58] Field of Search ..... 204/72, 78; 544/336

[56] References Cited

U.S. PATENT DOCUMENTS 4,488,944 12/1984 Stutts et al. ..... 204/79
4,496,440 1/1985 Campbell et al. ..... 204/78
4,640,750 2/1987 Blickle ..... 204/79

FOREIGN PATENT DOCUMENTS 2099820 12/1982 Fed. Rep. of Germany .

OTHER PUBLICATIONS

Kaulen et al., "Oxidation of Primary Alcohols to Carboxylic Acids at Nickel Hydroxide Electrode", Synthesis, pp. 513-516, Jul. 1979.

Barlin, G. B., "The Pyrazines", John Wiley & Sons, New York, 1982.

*Primary Examiner*—John Niebling
*Assistant Examiner*—Steven P. Marquis
*Attorney, Agent, or Firm*—Morgan & Finnegan

[57] ABSTRACT

There is disclosed a process for the preparation of 2-methyl-5-pyrazinoic acid consisting of electrochemically oxidizing a compound having formula:

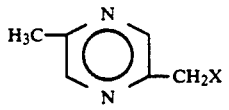

(I)

wherein X is —OH, Cl, Br, —O—CO—R, —O—SO$_2$—R, in which R is a $C_1$-$C_5$ alkyl radical, optionally substituted with F or Cl, or it is a $C_6$-$C_{12}$ aryl radical, in an aqueous alkaline medium, at a temperature ranging from 20° C. to 90° C., using anodes coated with nickel oxide-hydroxide.

6 Claims, No Drawings

ELECTROCHEMICAL SYNTHESIS OF 2-METHYL-5-PYRAZINOIC ACID

This is a continuation of co-pending application Ser. No. 07/271,675, filed on Nov. 16, 1988.

FIELD OF THE INVENTION

The present invention relates to a process for the preparation of 2-methyl-5-pyrazinoic acid by electrochemical oxidation of a functional derivative of 2,5-dimethylpyrazine, on a nickel oxide-hydroxide anode.

BACKGROUND OF THE INVENTION 2-methyl-5-pyrazinoic acid is the key-intermediate for the preparation of ACIPIMOX® 2-methyl-5-pyrazinoic-1-oxide, an important antihypertensive drug.

From U.K. patent 2,099,820 it is known, how to prepare 2-methyl-5-pyrazinoic acid by condensation of pyruvic aldehyde with diaminodicyanoethylene and subsequent reaction of thus obtained 5-methyl-2,3-dicyanopyrazine with an acid in an aqueous medium.

The reaction between 5-methyl-2,3-dicyanopyrazine with the acid, however, is not selective and gives rise to the formation of equimolecular mixtures of 2-methyl-5-pyrazinoic acid and of 2-methyl-6-pyrazinoic acid, exhibiting the further drawback connected with the separation of said acids.

Moreover from G. B. Barlin "THE PYRAZINES" JOHN WILEY. Ed. page 79 (1982), it is known, how to prepare 2-methyl-5-pyrazinoic acid by oxidation of 2,5-dimethylpyrazine or of 2-methyl-5-oxymethylpyrazine with potassium permanganate.

The above described process, however, proves not to be suitable for an industrial economic production, mostly owing to the considerable amounts of potassium permanganate, which need to be used (from 1 to 2 moles of $KMnO_4$ per mole of substrate) and to the problems connected with the separation and disposal of large amounts of wastes.

Moreover, the reaction between 2,5-dimethylpyrazine with $KMnO_4$ is not selective and gives rise to the formation of considerable amounts of 2,5-dicarboxypyrazine as well.

From J. Kaulen et al.—"Synthesis", 513–516 (1979) it is also known, how to electrochemically oxidize primary alcohols on NiO(OH) nickel oxide-hydroxide anode.

DETAILED DESCRIPTION OF THE INVENTION

It was now found that 2-methyl-5-pyrazinoic acid can be obtained with high yields and conversions by electrochemical oxidation of 2,5-dimethylpyrazine derivatives on anodes coated with NiO(OH) nickel oxide-hydroxide.

Therefore the object of the present invention is a process for the preparation of 2-methyl-5-pyrazinoic acid consisting in subjecting to electrochemical oxidation a compound having general formula:

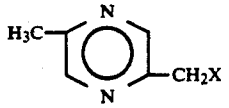

(I)

wherein: X represents OH, Cl, Br,

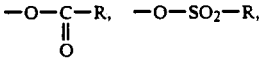

in which R is a $C_1$–$C_5$ alkyl radical, optionally substituted with one or more atoms of F or Cl, or it is a $C_6$–$C_{12}$ aryl radical, in an electrochemical cell, by using anodes coated with NiO(OH) nickel oxide-hydroxide, in an aqueous alkaline medium, containing at least 5 equivalent moles of a base per mole of compound (I), when X=OH or at least 6 equivalent moles of a base per mole of compound (I), when X is Cl, Br,

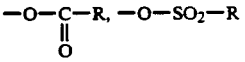

and, optionally an organic solvent for compound (I), which solvent is miscible with water and inert under the reaction conditions, at a temperature ranging from 20° to 90° C.

The anodic reaction can be schematized as follows:

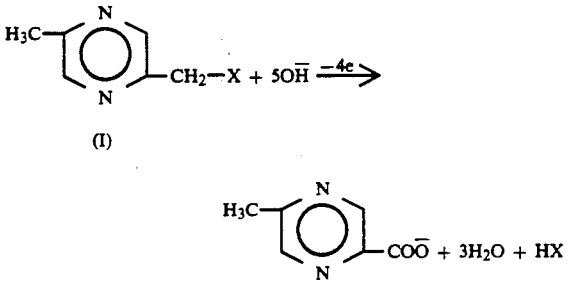

(I)

(II)

The concentration of compound (I) in the aqueous basic solution is not critical and can vary between 0.01 and 1 moles/liter, preferably between 0.03 and 0.8 moles/liter.

Hydroxides, carbonates, bicarbonates of alkaline and alkaline-earth metals can be used, for instance, as base.

Tertiary butyl alcohol, tertiary amyl alcohol, acetonitrile can be used, for instance, as organic solvents, which are mixable with water and inert under the reaction conditions.

Such solvents are used preferably to obtain the best yields in 2-methyl-5-pyrazinoic acid (II), when in compound (I), X is Cl or Br.

In the oxidation reaction use can be made of current densities ranging from 5 to 100 mA/cm$^2$, preferably from 8 to 70 mA/cm$^2$.

The quantity of current necessary for the complete conversion of compound (I) into compound (II) can range from 4 to 10 F/mole.

The temperature of oxidation reaction generally ranges from 20° to 90° C., preferably from 30° to 70° C.

When the electrochemical oxidation reaction is over, the reaction mixture is acidified up to isoelectric pH of 2-methyl-5-pyrazinoic acid (about pH 1.5).

2-Methyl-5-pyrazinoic acid can be extracted, using an organic solvent, from the resultant solution, after having salted the solution or after having evaporated the water.

Compounds of formula (I) are known or they can be prepared by known methods, from 2,5-dimethylpyrazine or from its derivatives.

For instance, the compounds of formula (I), when X is Cl or Br, can be prepared by reaction of 2,5-dimethylpyrazine with the customary halogenation agents such as N-chloro-(bromo)-succinimmide or with sulfuryl chloride.

The compounds of formula (I), when X is

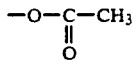

can be obtained by reaction of N-oxide of 2,5-dimethylpyrazine with acetic anhydride, or by exchange reaction between 2-halogenmethyl-5-methylpyrazine with an alkaline acetate.

The compounds of formula (I), when X is —OH, can be obtained by hydrolysis of the corresponding halogen derivative or of the corresponding acyloxymethyl or organic sulfonates.

The compounds of formula (I), when X is —O—SO$_2$—R can be obtained from the corresponding 2-halogenmethyl-5-methylpyrazines by exchange with an alkaline sulfonate.

The cathodic material of the electrochemical cell is not critical, and it generally consists of stainless steels of different kind.

The NiO(OH) nickel oxide-hydroxide anode is prepared, as known from the prior art, by electrolysis, in an electrochemical cell, of an aqueous alkaline solution of a nickel salt, by changing the electrode polarity by cycles.

The time required for every cycle can range within large limits, from very few seconds to some minutes, taking care that the electrode, which will be used as anode in the reaction of electrochemical oxidation, remains in anodic polarity for a longer time compared with the counter-electrode.

The cycle number may range within large limits as well, according to the desired thickness of NiO(OH) on the electrode and to the modalities. The cyclic polarization of the electrodes is carried out.

The preferred materials going to make up the electrode, which will be used as work electrode in the oxidation reaction, are stainless steels, nickel, noble metals belonging to the platinum group, in the form of a sheet or a net.

The material, the counter-electrode consists of, is not critical; and it generally consists of stainless steels of different kind.

The preferred nickel salt is sulfate, other nickel salts may be, however, used, such as, for instance, nitrate.

The salt concentration generally ranges from 0.05 to 2 moles/liter, preferably from 0.08 to 1.5 moles/liter.

The aqueous solution, wherein the nickel salt is dissolved, contains sodium acetate in an amount, that is substantially equimolecular with respect to the nickel salt and hydroxides of alkaline metals ranging from 0.003 to 0.01 moles/liter, preferably from 0.004 to 0.006 moles/liter.

For the preparation of the electrode coated with NiO(OH) use is made of densities of current ranging from 1 to 25 mA/cm$^2$, preferably from 3 to 10 mA/cm$^2$.

A few examples will be given, by way of illustration, but not of limitation.

EXAMPLE 1

Preparation of 2-methyl-5-pyrazinoic acid by oxidation of 2-methyl-5-oxymethylpyrazine 1) Preparation of the electrode coated with NiO(OH)

99 ml of $H_2O$, 2.93 g (10.3 millimoles) of $NiSO_4.7H_2O$, 0.96 g (11.6 millimoles) of sodium acetate, 1 ml of a solution of 0.5N sodium hydroxide (0.0005 moles) were introduced into an undivided electrochemical cell containing an anode consisting of a nickel net being 24 cm$^2$ in surface and a cathode consisting of a Incoloy 825 wire. The nickel net electrode was polarized by anodic way for 60 seconds by passing a constant current of 120 mA, afterwards the polarity was inverted for 10 seconds. The cycle was repeated 10 times and at the end the net electrode was kept for 2 minutes under anodic polarity. At the end of this procedure, the nickel net electrode, a NiO(OH) layer had deposited on, was rinsed with water and used in another electrochemical cell for the subsequent oxidation reaction.

2) Electrochemical oxidation 90 ml of an aqueous solution containing 3.6 g of NaOH and 0.480 g (3.87 millimoles) of 2-methyl-5-oxymethylpyrazine were introduced into an undivided electrochemical cell which contained the anode coated with NiO(OH), prepared as above described and a cathode which consisted of an Incoloy 825 wire.

The temperature was brought to 40° C. and the electric current was passed at a constant density of 12 mA/cm$^2$. The electrolysis was continued till the passage of 6 F per mole of 2-methyl-5-oxymethylpyrazine.

The reaction crude product was acidified with HCl up to a pH of about 1.5, the water was evaporated and the residue was extracted by means of methylethylketone. From the extract, after evaporation of the solvent, 3.6 millimoles of 2-methyl-5-pyrazinoic acid were recovered, with a yield of 93%.

EXAMPLE 2

100 ml of an aqueous solution containing 6 g of NaOH and 2.56 g of 2-methyl-5-acetoxypyrazine were introduced into an undivided electrochemical cell containing an anode coated with NiO(OH), prepared as described in example 1 and a cathode consisting of an Incoloy 825 wire. The reaction mixture was electrolyzed at 40° C., with a constant density of current, of 12 mA/cm$^2$ till the passage of 9.000 Coulomb.

When the electrolysis was over, the reaction crude product was acidified with HCl up to a pH of about 1.5, the water was evaporated and the residue was extracted by means of methylethylketone.

From the extract, after evaporation of the solvent, 1.893 g of 2-methyl-5-pyrazinoic acid were recovered, with a yield of 89%.

EXAMPLE 3

A solution consisting of 15 g of $K_2CO_3$ and 10 g of tertiary butyl alcohol dissolved in 70 ml of water and 0.684 g of 2-chloromethyl-5-methylpyrazine were introduced into an undivided electrochemical cell containing an anode coated with NiO(OH), prepared as described in example 1, and a cathode consisting of an Incoloy 825 wire.

The reaction mixture was electrolyzed at 60° C., with a constant density of current of 12 mA/cm$^2$, till the passage of 6 F per mole of 2-chloromethyl-5-methylpyrazine.

When the electrolysis was over, the azeotropic mixture $H_2O$/terbutanol was evaporated from the reaction crude product; one diluted slightly with $H_2O$, one acidified with dilute HCl up to a pH of about 1.5, one dried, afterwards the residue was extracted by means of methylethylketone.

From the extract, after evaporation of the solvent, 0.491 g of 2-methyl-5-pyrazinoic acid was recovered, with a yield of 74%.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims.

What we claim is:

1. A process for the preparation of 2-methyl-5-pyrazinoic acid consisting in subjecting to electrochemical oxidation a compound having formula:

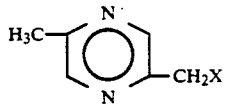

(I)

wherein X is Cl, Br, —O—CO—R, —O—$SO_2$—R, in which R is a $C_1$–$C_5$ alkyl radical, optionally substituted with one or more atoms of F or Cl, or it is a $C_6$–$C_{12}$ aryl radical, in an electrochemical cell, by using anodes coated with NiO(OH) nickel oxide-hydroxide, in an aqueous medium containing at least 6 equivalent moles of a base per mole of compound (I), at a temperature ranging from 20° to 90° C.

2. A process according to claim 1, wherein the aqueous alkaline medium further contains an organic solvent for compound (I), which solvent is miscible with water and inert under the reaction conditions.

3. A process according to claim 2, wherein the solvent is acetonitrile.

4. A process according to claim 1, wherein the concentration of compound (I) in the aqueous alkaline solution ranges from 0.01 and 1 mole/liter.

5. A process, according to claim 1, wherein the base is selected from the group comprising hydroxides, carbonates or bicarbonates of alkaline or alkaline earth metals.

6. A process according to claim 1, wherein in the electrochemical oxidation use is made of current density ranging from 5 to 100 mA/$cm^2$.

* * * * *